United States Patent [19]

Backman

[11] Patent Number: 4,991,376

[45] Date of Patent: Feb. 12, 1991

[54] METHOD AND APPARATUS FOR WRAPPING A PRODUCT, PARTICULARLY WRAPPING A BUNDLE OF NEWSPAPERS OR MAGAZINES IN PLASTIC FILM

[75] Inventor: Ralf Backman, Eksjo, Sweden

[73] Assignee: Wamac AB, Sweden

[21] Appl. No.: 303,443

[22] Filed: Jan. 27, 1989

[30] Foreign Application Priority Data

Jan. 28, 1988 [SE] Sweden ..... 88002670

[51] Int. Cl.[5] ..... B65B 13/04; B65B 27/08; B65B 41/16; B65B 57/12

[52] U.S. Cl. ..... 53/399; 53/74; 53/389; 53/463; 53/466; 53/553; 53/586

[58] Field of Search ..... 53/64, 66, 74, 228, 53/399, 463, 466, 586, 553, 229, 389, 555

[56] References Cited

U.S. PATENT DOCUMENTS

| | | | |
|---|---|---|---|
| 3,465,489 | 9/1969 | Monaghan | 53/553 X |
| 3,559,367 | 2/1971 | Misik | 53/586 X |
| 3,990,215 | 11/1976 | Elsner et al. | 53/389 X |
| 4,024,692 | 5/1977 | Young | 53/466 X |
| 4,313,288 | 2/1982 | Tassi | 53/74 |
| 4,413,463 | 11/1983 | Lancaster | 53/399 |
| 4,509,314 | 4/1985 | Bozza | 53/229 X |
| 4,782,648 | 11/1988 | Van Ottele | 53/586 X |
| 4,831,809 | 5/1989 | Ballestrazzi | 53/64 |

FOREIGN PATENT DOCUMENTS 2449597 10/1980 France ..... 53/228

*Primary Examiner*—Robert L. Spruill
*Assistant Examiner*—Linda B. Johnson
*Attorney, Agent, or Firm*—Ostrolenk, Faber, Gerb & Soffen

[57] ABSTRACT

A method and an apparatus for wrapping a product, particularly a bundle of newspapers or magazines, especially an extra thick bundle or an extra thin bundle comprising a few or a single newspaper or magazine. The product is carried on a conveyor system through a plane towards a curtain of film formed by an upper and a lower sheet of film. The curtain thus accompanies the product and is auto-sealed behind the product, after which the sheets of film are separated in the middle of the sealing region, the curtain of film being re-established and the product being provided with a wrapper. The deflection roller or the like which defines the upper limit of the sheet of film is carried by drive device such as cylinders which are arranged to displace the deflection roller in such a way that its upper portion will be supplied quickly and substantially without tensile force at the start of a wrapping operation if the height of the product is slight, or at the end of the wrapping operation if the height of the product is particularly great.

12 Claims, 1 Drawing Sheet

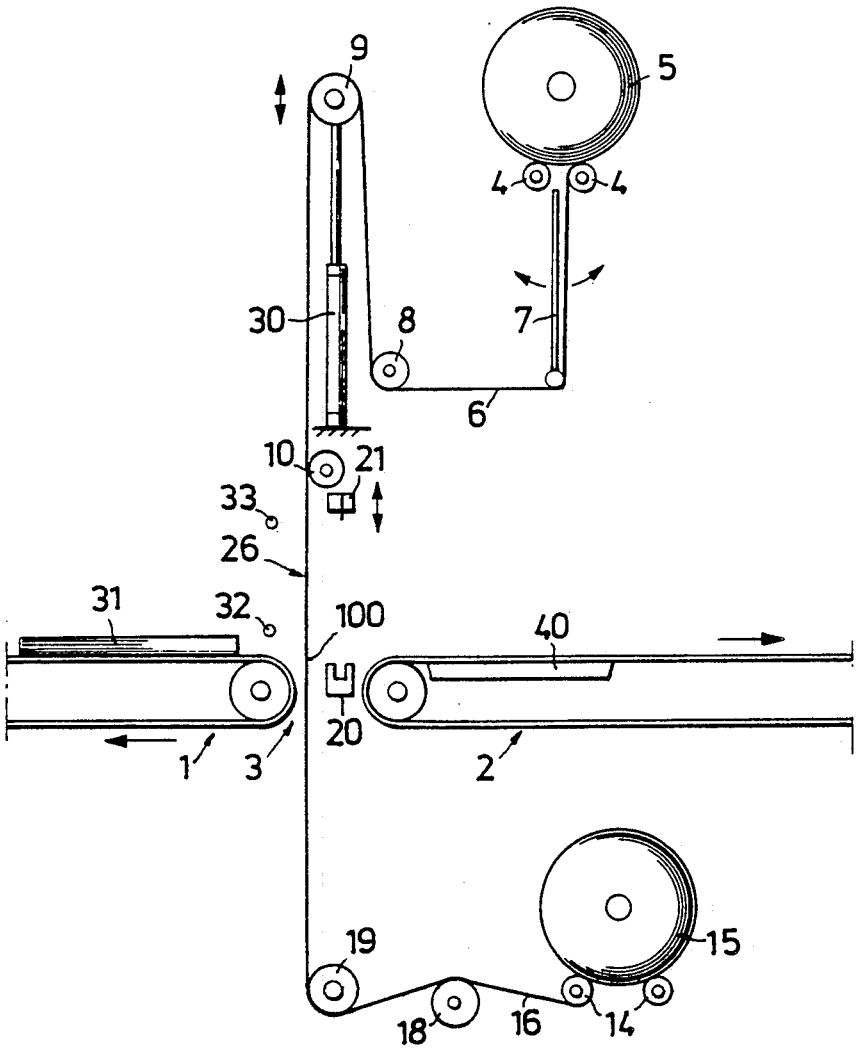
9
5
4
4
30
8
7
6
10
21
33
26
31
32
100
40
20
1
3
2
19
15
18
16
14

METHOD AND APPARATUS FOR WRAPPING A PRODUCT, PARTICULARLY WRAPPING A BUNDLE OF NEWSPAPERS OR MAGAZINES IN PLASTIC FILM

The present invention relates to a method of wrapping a product, particularly a stack or bundle comprising a large or small number of newspapers or magazines or a single newspaper or magazine, the product being carried along a conveyor system through a plane towards a curtain of film formed in said plane by an upper and a lower sheet of film, the curtain accompanying the product and then being auto-sealed behind the product, a film wrapper being produced around the product and the curtain being re-established in the place after shearing of the two sheets of film in the sealing region. The invention also relates to an apparatus for performing the method.

The efficient handling of newspapers or magazines includes collecting them into bundles of various sizes for distribution to specified distribution points. Each "bundle" may comprise only a few or even only one newspaper or magazine. The bundles are provided individually with a plastic wrapper to protect them from rain and wind during transport to the distribution points, said wrapper being produced in the manner described, using the apparatus indicated above. The wrapper is preferably wider than the bundle and, if desired, can also be sealed at the sides to form a closed casing around the bundle.

However, a troublesome problem when wrapping these "bundles" in plastic film is that the small bundles (comprising one or a few newspapers or magazines) are insufficiently stable to accompany the curtain of film during the wrapping operation without deformation. Previous methods, at least at the section of the bundle conveyor located on the far side of the film curtain, having included accompanying suction means operating against the lower part of the plastic film accompanying the bundle, and attempts have been made to supply an airflów directed towards the concave side of the plastic curtain accompanying the bundle. However, such measures have been insufficient in the case of said small bundles, the tensile force in the portion of the curtain above the bundle causing the front of the bundle to be distorted, i.e., curve upwards, relative movement between bundle and conveyor, or movement between the individual newspapers or magazines in a bundle.

According to the invention said inconveniences are eliminated by supporting the sheet of film forming the upper portion of the curtain on a deflection member (e.g. a roll, skid rail or the like) and displacing said deflection member in conjunction with the wrapping operation, so that film is supplied to top of the curtain quickly and substantially without tensile force. For this purpose the deflection member, e.g. a rotating roll, may be supported by one or more cylinders such as vertically operating cylinders. The sheet of film may suitably be deflected about 180° and a loosely rotating roll is preferable in order to minimize the tensile force in the sheet of film forming the curtain portion located above the conveyor.

However, it should be evident that the inventive concept lies in the roll or the like which substantially defines the upper edge of the curtain being displaceable, suitably in parallel, so that the stretch of film around said roll can be released to the curtain by displacement of the roll.

Similarly to the known technique, the method according to the invention may include the sheet of film supplied to the upper part of the curtain being taken from a roll supported in conventional manner allowing it to rotate and the film to be unwound, and also being connected to a feeding and storage arrangement. Such a storage arrangement may consist of a swing-arm or the like, which limits the pulling forces in the sheet of film.

However, it has not been possible with the conventional storage arrangements used previously to achieve sufficiently low pulling forces for the sheet of film being supplied to the upper portion of the current. The mobility of the upper deflection roll achieved according to the invention, however, minimizes the contact pressure between film and deflection roll, this roll in effect defining the upper edge of the curtain. It also permits a considerable length of film to be released to the upper portion of the curtain, or rather to the wrapper produced around the product, by an active displacement movement of the deflection roll. The distance covered by the deflection roll is of course dependent on the relevant geometry, but should preferably correspond to half the length of the bundle. The speed at which the deflection roll is displaced is suitably such that the extra length of film is released at a speed substantially corresponding to or even exceeding the speed of transport of the bundle. If the sheet of film surrounds about 180° of the deflection roll, the stroke length of the cylinders may substantially correspond to the length of the bundle in the direction of transport. The return movement of the cylinders is suitably performed while the welding jaws clamp the upper and lower parts of the curtain together, thus pulling film from the upper storage roll for the film. However, it should be clear that the return movement of the cylinders may also be performed after the welding jaws have welded together the upper and lower sheets of film and released them. In this case the sheet of film being supplied to the lower part of the curtain may be arranged with a certain resistance, thus allowing the cylinders, via the deflection roll, to pull out more film from the upper film roll.

An apparatus according to the invention, for performing the method, comprises a conveyor, suitably a generally horizontal conveyor with a gap, an upper deflection member and a lower deflection member being arranged to define a curtain of film which extends through the gap in the conveyor, said curtain being arranged to be supplied with an upper sheet of film and a lower sheet of film from respective stocks, the means comprising members located at the gap to weld the curtain to form a wrapper around a bundle carried along the conveyor past said gap, and to separate the wrapped bundle while forming a seal between the two sheets of film so that the curtain is maintained, said apparatus being characterised according to the invention substantially in that the deflection member which last deflects the upper sheet of film prior to the actual curtain is provided with drive means able to displace said deflection member. Sensing means may be arranged to sense the arrival of a bundle at the curtain and to initiate displacement of the deflection member, said displacement movement being caused by said cylinders or any other equivalent drive means.

The invention will be described in more detail with reference to an example shown schematically in the drawing.

BRIEF DESCRIPTION OF THE DRAWINGS

The drawing shows schematically a vertical side view of a preferred embodiment of the invention.

The drawing shows a first and a second part, 1 and 2, of a conveyor, with a gap 3 therebetween. The direction of movement of the conveyor 1, 2 is indicated by arrows. A product 31, such as a bundle of newspapers or magazines comprising one paper or a number of papers stacked one on top of the other, arrives on the conveyor part 1 to traverse the gap 3 and continue to the right on the conveyor part 2.

At the top of the drawing is a pair of support rolls 4, carrying a roll 5 of plastic film 6 which, via a swing-arm 7 and a deflection roll 8 extends 180° around a deflection roll 9.

The sheet of film 6 passes downwardly from the roll 9 to a welding seam 100 at the level of the conveyor 1, 2. Below the conveyor are two support rolls 14 which rotatably carry a roll 15 of plastic film allowing a sheet of film 16 to be fed via a preferably spring-loaded equalizing roll 18 and a deflection roll 19, up to the welding seam 100. The continuous sheets of film 6 and 16 thus form a curtain 26 which extends between the deflection rolls 9 and 19, through the gap 3, the curtain 26 being substantially spread in the normal plane perpendicular to the direction of movement of the bundles on the conveyor 1, 2.

A deflection roll 10 is also shown in the drawing, located above the gap 3, below the roll 9 and behind the curtain 26. The deflection roll 10 comes into operation when a bundle is transferred from conveyor part 1 to conveyor part 2, drawing the curtain with it, so that the upper portion of the curtain can pass around the deflection roll 10.

A lower welding jaw 20 is also shown in conjunction with the gap 3, said jaw being provided in conventional manner with two parallel welding bars and a recess between. A welding jaw 21 having two separate welding surfaces and a knife between them is located above the conveyor belts at such a height as to allow bundles of the desired thickness to pass below the jaw 21. The welding surfaces of the jaws 20, 21 may be heated.

When a bundle to be provided with plastic film wrapping has pulled the curtain 26 to the right in the drawing, and its rear edge in the direction of transport has passed the plane defined by the jaws 20, 21, this upper jaw 21 can be moved downwards, thus sealing the curtain portions together along two parallel welding seams, and simultaneously shearing the plastic film between the two welded seams. When the jaw 21 is raised, the wrapped bundle is released and the curtain 26 is again established ready for a new wrapping operation.

The apparatus described so far can be considered to constitute the state of the art. According to the invention the upper deflection roll 9 is supported by two cylinders 30, only one of which is shown. The two vertical cylinders 30 are arranged to effect vertical parallel displacement of the deflection roll 9 in a downward direction as the front edge of a bundle 31 approaches the curtain 26, this being sensed by a sensor 32 in the conveyor for the bundle 31. The upper portion of the curtain 26 will thus be lowered as the deflection roll 9 is lowered. The tension in the film between rolls 8 and 9 will be relieved and the film may even crease if the arm 7 is not loaded. The contact pressure of the film 6 against the roll 9 will thus be minimum and the creased section of film between rolls 8 and 9 can therefore be pulled round the preferably loosely rotating roll 9 with a minimum of friction. It will be understood that the section of curtain 26 intended to cover the bundle 31, will be unable to exert any great tensile force on the front end of the bundle 31, which is thus able to retain its shape and its position on the conveyor 1, 2.

The lower film 16 drawn along by the belt in the conveyor part 2, and a schematically indicated suction device 40 accompanying the belt assists the progress of the film 16 and thus of the bundle thereon, to the right on the conveyor part 2. It is therefore important to ensure that the lower welding jaw 20 is so located that the curtain 26 is best brought into contact with the belt on the conveyor part 2 when the bundle 31 pushes the curtain 26 to the right.

It has been found that the apparatus described allows bundles comprising a single newspaper or magazine to be wrapped without causing any disturbance, whereas the same plastic film wrapping apparatus with a fixed roll 9 caused disturbances and cannot in practice be used for small bundles.

Finally it should be added that the apparatus according to the invention is advantageous even for bundles of considerable thickness/height, if the cylinders 30 or equivalent are activated at the end of the wrapping operation to release a section of the upper curtain having low tension, since this prevents the front of the bundle being pushed backwards when the upper welding jaw 21 descends.

A sensing means 33 may be placed to sense the height of the approaching bundle. The means 33 then suitably permits the sensor 32 to directly activate the cylinders 30 if the height of the bundle is less than a predetermined value or, if the height of the bundle is greater than the bundle height-mark, to delay activation of the cylinders until the rear of the bundle is located in the gap 3. The sensor can then be arranged to sense the rear edge of the bundle and substantially immediately initiate operation of the cylinders.

I claim:

1. A method of wrapping a product, the product being a stack of newspapers or magazines or a single newspaper or magazine, the product being carried on a conveyor system such that the product (1) approaches a curtain of film formed in a plane by an upper and a lower film and then (2) passes through the plane, the curtain accompanying the product and then being auto-sealed behind the product, a film wrapper being produced around the product which, after shearing in the sealing region, is separated from the curtain, the method further comprising:

sensing the product as the product approaches the curtain; and responsive to the sensing of the product, displacing a deflection member for the upper film as the product approaches the curtain so that film is supplied to the top of the curtain quickly and substantially without tensile force, the deflection member substantially defining the upper limitation of the curtain.

2. A method as claimed in claim 1, comprising displacing the deflection member to its starting position while the curtain is auto-sealed.

3. A method of wrapping a product, the product being carried on a conveyor system through a plane towards a curtain of film formed in the plane by an upper and a lower film, the curtain accompanying the product and then being auto-sealed behind the product, a film wrapper being produced around the product which, after shearing in the sealing region, is separated from the curtain;

wherein a deflection member for the upper film is displaced in conjunction with the wrapping operation so that film is supplied to the top of the curtain quickly and substantially without tensile force;

the method further comprising sensing the height of the approaching product and, in response to the sensing of the height of the approaching product, (1) initiating the displacement of the deflection member at the start of the wrapping operation if the height of the product is less than a certain predetermined value and (2) initiating the displacement of the deflection member at the end of the wrapping operation if the height of the product exceeds the certain predetermined value.

4. The method of claim 3, wherein the product is a stack of newspapers or magazines or a single newspaper or magazine.

5. An apparatus for wrapping a product, the product being a stack of newspapers or magazines or a single newspaper or magazine, the apparatus comprising a generally horizontal conveyor (1, 2) with a gap (3), an upper stock (5) for an upper film (6), a lower stock (15) for a lower film (16), first and second deflection members (9, 19) to establish a curtain of film (26) running through the gap (3), the first deflection member (9) being for the upper film (6), the curtain being formed by the upper film (6) and the lower film (16), a sensor (32) for sensing the product, and sealing and shearing means (20, 21) to form a film wrapper around each product and separate it from the curtain, the first deflection member (9) being supported by a displacement member (30) to achieve displacement of the first deflection member (9) in response to the sensing of the product as the product approaches the curtain, the upper part of the curtain thereby being quickly supplied with film while its tensile force is reduced, the first deflection member (9) substantially defining the upper edge of the curtain (26).

6. The apparatus of claim 5, wherein the first deflection member is located substantially directly above the gap.

7. The apparatus of claim 6, wherein the first deflection member includes a roller.

8. The apparatus of claim 7, further comprising a third deflection member (8) for controlling the upper film, the third deflection member being located substantially directly beneath the first deflection member.

9. The apparatus of claim 8, wherein the displacement member includes a vertical cylinder for displacing the first deflection member downwardly to reduce the tensile force of the curtain.

10. An apparatus for wrapping a product, comprising a generally horizontal conveyor (1, 2) with a gap (3), an upper stock (5) for an upper film (6), a lower stock (15) for a lower film (16), first and second deflection members (9, 19) to establish a curtain of film (26) running through the gap (3), the first deflection member (9) being for the upper film (6), and sealing and shearing means (20, 21) to form a film wrapper around each product and separate it from the curtain, the first deflection member (9) being supported by a displacement member (30) for displacing the first deflection member in conjunction with the wrapping operation, the upper part of the curtain thereby being quickly supplied with film while its tensile force is reduced; and means (33) for sensing the height of a product approaching on the conveyor, the displacement member being responsive to the sensing means (33) and arranged to initiate displacement of the first deflection member at the start of the wrapping operation if the height of the product is less than a certain predetermined value and to initiate displacement of the deflection member (9) at the end of the wrapping operation if the height of the product exceeds the certain predetermined value.

11. The method of claim 10, wherein the product is a stack of newspapers or magazines or a single newspaper or magazine.

12. A method of wrapping a product without distorting a leading edge of the product, the method comprising:

(A) supporting a curtain of film between an upper deflection member and a lower deflection member such that the curtain of film extends through a gap in a conveyor system;

(B) conveying the product across the gap in the conveyor system such that the leading edge of the product is pushed into the curtain; and (C) as the leading edge of the product is conveyed across the gap and as the leading edge of the product is pushed into the curtain, reducing the tension within the film by lowering the upper deflection member.

* * * * *